US010861368B2

(12) United States Patent
Zheng et al.

(10) Patent No.: US 10,861,368 B2
(45) Date of Patent: Dec. 8, 2020

(54) DRIVING METHOD FOR DISPLAY PANEL

(71) Applicant: WUHAN CHINA STAR OPTOELECTRONICS TECHNOLOGY CO., LTD., Hubei (CN)

(72) Inventors: Lihua Zheng, Hubei (CN); Mang Zhao, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 0 days.

(21) Appl. No.: 16/492,137

(22) PCT Filed: May 7, 2019

(86) PCT No.: PCT/CN2019/085751
§ 371 (c)(1),
(2) Date: Sep. 8, 2019

(87) PCT Pub. No.: WO2020/186604
PCT Pub. Date: Sep. 24, 2020

(65) Prior Publication Data

US 2020/0302846 A1 Sep. 24, 2020

(30) Foreign Application Priority Data

Mar. 18, 2019 (CN) ..... 2019 1 0205035

(51) Int. Cl.
*G09G 3/20* (2006.01)

(52) U.S. Cl.
CPC ..... *G09G 3/20* (2013.01); *G09G 2300/0809* (2013.01); *G09G 2310/0202* (2013.01); *G09G 2310/0297* (2013.01); *G09G 2320/0233* (2013.01)

(58) Field of Classification Search
CPC ..... G09G 2310/0297
See application file for complete search history.

(56) References Cited

U.S. PATENT DOCUMENTS 10,783,848 B2 * 9/2020 Lee ..... G09G 3/3685
2005/0140633 A1 * 6/2005 Kato ..... G09G 3/3614 345/96
2016/0180791 A1 * 6/2016 Lee ..... G09G 3/3614 345/213

(Continued)

*Primary Examiner* — Kevin M Nguyen
(74) *Attorney, Agent, or Firm* — Mark M. Friedman

(57) ABSTRACT

A driving method for a display panel is through making the first demultiplexing signal, the second demultiplexing signal, the third demultiplexing signal, the fourth demultiplexing signal, the fifth demultiplexing signal and the sixth demultiplexing signal according to the first sequence generate the high-level pulse in the first image frame, and through making the first demultiplexing signal, the second demultiplexing signal, the third demultiplexing signal, the fourth demultiplexing signal, the fifth demultiplexing signal and the sixth demultiplexing signal according to the second sequence different from the first sequence generate the high-level pulse in the second image frame, thereby by adding the effect of the two image frames to eliminate stripes on the images displayed by the display panel to improve the display effect.

4 Claims, 17 Drawing Sheets

(56) References Cited

U.S. PATENT DOCUMENTS

| | | | | |
|---|---|---|---|---|
| 2016/0189657 | A1* | 6/2016 | Oh | G09G 3/3688<br>345/211 |
| 2017/0243559 | A1* | 8/2017 | Xi | G09G 3/3614 |
| 2017/0309230 | A1* | 10/2017 | Kwon | G09G 3/3275 |

* cited by examiner

DRIVING METHOD FOR DISPLAY PANEL

FIELD OF INVENTION

The present disclosure relates to a display technology field, and particular to a driving method for the display panel.

BACKGROUND OF INVENTION

With development of display technology, because liquid crystal displays (LCDs) and such flat-panel display devices have advantages of high picture quality, power savings, thin bodies and wide application range, having gradually replaced cathode ray tube (CRT) display screen and being widely applied in mobile phones, televisions, personal digital assistants, laptops, desktop computers and such consumer electronics, having be the mainstream display devices.

Most LCDs in the current market are backlight LCDs, which include a liquid crystal display panel and a backlight module. The working principle of a liquid crystal display panel is to dispose liquid crystal molecules between a thin film transistor (TFT) array substrate and a color filter (CF) substrate, and applying a driving voltage between the two substrates to control a rotational direction of liquid crystal molecules to refract light out of the backlight module to generate images.

In a driving structure of a tradition liquid crystal display, there are data lines and gate lines on each pixel electrode respectively, this method can well control the opening of the gate electrode on each of the scan lines and the data input on each of the data lines. However, with improvement of resolution of a liquid crystal display panel, the number of data lines and gate lines also increases, as a result, the area occupied by the fan-out route of the data lines increases, which affects a penetration rate and display effect. To solve this problem, a multiplexing driving structure is applied widely, such as one-to-six demultiplexer (De-mux) driving structure, the so-called one-to-six De-mux driving structure refers to the technology of using a data signal to charge six columns of pixels using the principle of time-division multiplexing. Please refer to FIG. 1, a display panel of a current one-to-six De-mux driving structure includes a plurality of driving units. Each of the driving units includes a plurality of pixels 100 which are arranged in a plurality of rows and four columns, twelve data lines 200, a plurality of scan lines 300 and a demultiplexing module 400. Each of the pixels 100 includes three subpixels 110 which are arranged in one of the rows, and the three subpixels 110 are a red subpixel r, a green subpixel g and a blue subpixel b sequentially. The colors of the subpixels 110 in a same column are same. One of the data lines 200 is correspondingly connected to a column of the subpixels 110, and one of the scan lines 300 is correspondingly connected to one row of the subpixels 110. The demultiplexing module 400 includes twelve thin film transistors T10 which respectively correspond to the subpixels 110, the drain electrodes of the thin film transistors T10 are respectively connected to the data lines 200 which are connected to their corresponding columns of subpixels 110. The source electrodes of the thin film transistors T10 corresponding to the odd integer column subpixels 110 are accessed to a 2N+1th data signal D2N+1, where N is a natural number, and the source electrodes of the thin film transistors T10 corresponding to the even integer column subpixels 110 are accessed to a 2Nth data signal D2N. A gate electrode of the thin film transistors T10 which the red subpixels r of the first column pixels 100 and the second column pixels 100 correspond to is accessed a first demultiplexing signal DEMUX10; a gate electrode of the thin film transistors T10 which the green subpixels g of the first column pixels 100 and the second column pixels 100 correspond to is accessed a second demultiplexing signal DEMUX20; a gate electrode of the thin film transistors T10 which the blue subpixels b of the first column pixels 100 and the second column pixels 100 correspond to is accessed a third demultiplexing signal DEMUX30; a gate electrode of the thin film transistors T10 which the red subpixels r of the third column pixels 100 and the fourth column pixels 100 correspond to is accessed a fourth demultiplexing signal DEMUX40; a gate electrode of the switch elements which the green subpixels g of the third column pixels 100 and the fourth column pixels 100 correspond to is accessed a fifth demultiplexing signal DEMUX50; a gate electrode of the thin film transistors T10 which the blue subpixels b of the third column pixels 100 and the fourth column pixels 100 correspond to is accessed a sixth demultiplexing signal DEMUX60.

During driving, the display panel includes a plurality of frame periods which are sequentially performed, each of the frame periods includes a plurality of row periods, the plurality of scan lines 300 are in a high electric level sequentially in the plurality of row periods. Please refer to FIG. 2, in each of the row periods, the first demultiplexing signal DEMUX10, the second demultiplexing signal DEMUX20, the third demultiplexing signal DEMUX30, the fourth demultiplexing signal DEMUX40, the fifth demultiplexing signal DEMUX50 and the sixth demultiplexing signal DEMUX60 sequentially generate a high-level pulse to open the corresponding thin film transistors T10 to transmit the data signal to the corresponding subpixels 110. This driving method can reduce the area of the space occupied by fan-out route of the data lines to realize a narrow bezel. However, in the prior art, when scanning each of the row periods in each of the frame periods, a charging sequence of the plurality of the subpixels 110 is: first charging the pixels 100 of the first column and the second column, and then charging the pixels 100 of the third column and the fourth column. When the pixel is undercharged and the common voltage fluctuates, the display effect of the pixels 100 charged first is better than the display effect of the pixels 100 charged afterwards. Eventually, when the actual display is performed, a significant difference in brightness between the pixels 100 of the first column and the second column and pixels 100 of the third column and the fourth column as illustrated in FIG. 3 occurs, thereby stripes appearing on the images displayed by the display panel to affect the display effect.

SUMMARY OF INVENTION

The purpose of the present disclosure is to provide a driving method for a display panel to eliminate stripes on the images displayed by the display panel to improve the display effect.

In order to realize the purpose mentioned above, the present disclosure provides a driving method for a display panel, including:

Step S1: providing a display panel.

The display panel includes a plurality of driving units; each of the driving units includes a plurality of pixels which are arranged in a plurality of rows and four columns, twelve data lines and a demultiplexing module; each of the pixels includes three subpixels which are arranged in one of the rows, and the three subpixels are a first subpixel, a second subpixel and a third subpixel sequentially, one of the data lines is correspondingly connected to one subpixel; the demultiplexing module includes twelve switch elements which respectively correspond to the subpixels, output ends of the twelve switch elements are respectively connected to the data lines connected to their corresponding columns of the subpixels; the output ends corresponding to the odd integer column subpixels are accessed to a 2n+1th data signal, where n is a natural number, and the output ends corresponding to the even integer column subpixels are accessed to a 2nth data signal; a control terminal of the switch elements which the first subpixels of the first column pixels and the second column pixels correspond to is accessed a first demultiplexing signal; a control terminal of the switch elements which the second subpixels of the first column pixels and the second column pixels correspond to is accessed a second demultiplexing signal; a control terminal of the switch elements which the third subpixels of the first column pixels and the second column pixels correspond to is accessed a third demultiplexing signal; a control terminal of the switch elements which the first subpixels of the third column pixels and the fourth column pixels correspond to is accessed a fourth demultiplexing signal; a control terminal of the switch elements which the second subpixels of the third column pixels and the fourth column pixels correspond to is accessed a fifth demultiplexing signal; a control terminal of the switch elements which the third subpixels of the third column pixels and the fourth column pixels correspond to is accessed a sixth demultiplexing signal.

Step S2: entering in to a first image frame.

In each of the first image frame, the first demultiplexing signal, the second demultiplexing signal, the third demultiplexing signal, the fourth demultiplexing signal, the fifth demultiplexing signal and the sixth demultiplexing signal sequentially generate a high-level pulse according to a preset first sequence.

step S3: entering in to a second image frame.

In each of the second image frame, the first demultiplexing signal, the second demultiplexing signal, the third demultiplexing signal, the fourth demultiplexing signal, the fifth demultiplexing signal and the sixth demultiplexing signal sequentially generate a high-level pulse according to a preset second sequence, the first sequence is different from the second sequence.

The first sequence is: in the second image frame, during scanning each row of the subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal.

The second sequence is: in the second image frame, during scanning each row of the subpixels, sequentially generating the high-level pulse according to a sequence of the sixth demultiplexing signal, the fifth demultiplexing signal, the fourth demultiplexing signal, the third demultiplexing signal, the second demultiplexing signal and the first demultiplexing signal.

The first sequence is: in the first image frame, during scanning the odd row subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal; during scanning the even row subpixels, sequentially generating the high-level pulse according to a sequence of the sixth demultiplexing signal, the fifth demultiplexing signal, the fourth demultiplexing signal, the third demultiplexing signal, the second demultiplexing signal and the first demultiplexing signal.

The second sequence is: in the second image frame, during scanning the odd row subpixels, sequentially generating the high-level pulse according to a sequence of the sixth demultiplexing signal, the fifth demultiplexing signal, the fourth demultiplexing signal, the third demultiplexing signal, the second demultiplexing signal and the first demultiplexing signal; during scanning the even row subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal.

The first sequence is: in the first image frame, during scanning the 4i-3th row subpixels and the 4i-2th row subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal; during scanning the 4i-1th row subpixels and the 4ith row subpixels, sequentially generating the high-level pulse according to a sequence of the sixth demultiplexing signal, the fifth demultiplexing signal, the fourth demultiplexing signal, the third demultiplexing signal, the second demultiplexing signal and the first demultiplexing signal.

The second sequence is: in the second image frame, during scanning the 4i-3th row subpixels and the 4i-2th row subpixels, sequentially generating the high-level pulse according to a sequence of the sixth demultiplexing signal, the fifth demultiplexing signal, the fourth demultiplexing signal, the third demultiplexing signal, the second demultiplexing signal and the first demultiplexing signal; during scanning the 4i-1th row subpixels and the 4ith row subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal, where i is a positive integer.

The first sequence is: in the first image frame, during scanning each row of the subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal.

The second sequence is: in the second image frame, during scanning each row of the subpixels, sequentially generating the high-level pulse according to a sequence of the fourth demultiplexing signal, the fifth demultiplexing signal, the sixth demultiplexing signal, the first demultiplexing signal, the second demultiplexing signal and the third demultiplexing signal.

The first sequence is: in the first image frame, during scanning the odd row subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal; during scanning the even row subpixels, sequentially generating the high-level pulse according to a sequence of the fourth demultiplexing signal, the fifth demultiplexing signal, the sixth demultiplexing signal, the first demultiplexing signal, the second demultiplexing signal and the third demultiplexing signal.

The second sequence is: in the second image frame, during scanning the odd row subpixels, sequentially generating the high-level pulse according to a sequence of the fourth demultiplexing signal, the fifth demultiplexing signal, the sixth demultiplexing signal, the first demultiplexing signal, the second demultiplexing signal and the third demultiplexing signal, during scanning the even row subpixels, sequentially generating the high-level pulse according a sequence of the first demultiplexing signal, the second demultiplexing signal, the third demultiplexing signal, the fourth demultiplexing signal, the fifth demultiplexing signal and the sixth demultiplexing signal.

The first sequence is: in the first image frame, during scanning the 4i-3th row subpixels and the 4i-2th row subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal; during scanning the 4i-1th row subpixels and the 4ith row subpixels, sequentially generating the high-level pulse according to a sequence of the fourth demultiplexing signal, the fifth demultiplexing signal, the sixth demultiplexing signal, the first demultiplexing signal, the second demultiplexing signal and the third demultiplexing signal.

The second sequence is: in the second image frame, during scanning the 4i-3th row subpixels and the 4i-2th row subpixels, sequentially generating the high-level pulse according to a sequence of the fourth demultiplexing signal, the fifth demultiplexing signal, the sixth demultiplexing signal, the first demultiplexing signal, the second demultiplexing signal and the third demultiplexing signal, during scanning the 4i-1th row subpixels and the 4ith row subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal, wherein i is a positive integer.

The switch element is a thin film transistor, the control terminal of the switch element is a gate electrode of the thin film transistor, an input end of the switch element is a source electrode of the thin film transistor, the output end of the switch element is a drain electrode of the thin film transistor.

Each of the driving units further includes a plurality of scan lines; one row of the subpixels is correspondingly connected to one scan line.

The durations of the high-level pulses of the first demultiplexing signal, the second demultiplexing signal, the third demultiplexing signal, the fourth demultiplexing signal, the fifth demultiplexing signal and the sixth demultiplexing signal are same.

Beneficial effects of the present disclosure is that the present disclosure provides an driving method for a display panel, through making the first demultiplexing signal, the second demultiplexing signal, the third demultiplexing signal, the fourth demultiplexing signal, the fifth demultiplexing signal and the sixth demultiplexing signal according to the first sequence generate the high-level pulse in the first image frame, and through making the first demultiplexing signal, the second demultiplexing signal, the third demultiplexing signal, the fourth demultiplexing signal, the fifth demultiplexing signal and the sixth demultiplexing signal according to the second sequence different from the first sequence generate the high-level pulse in the second image frame, thereby by adding the effect of the two image frames to eliminate stripes on the images displayed by the display panel to improve the display effect.

DESCRIPTION OF DRAWINGS

In order to further understand the features and technical contents of the present disclosure, please refer to the following detailed description and accompanying figures regarding to the present disclosure. The accompanying figures are provided for reference and description only and are not intended to limit the present disclosure.

DETAILED DESCRIPTION OF PREFERRED EMBODIMENTS

In order to further clarify the technical means and effects of the present disclosure, the following will be made in combined with the preferred embodiment of the present disclosure and the accompanying drawings for describing in detail.

Figure 1:
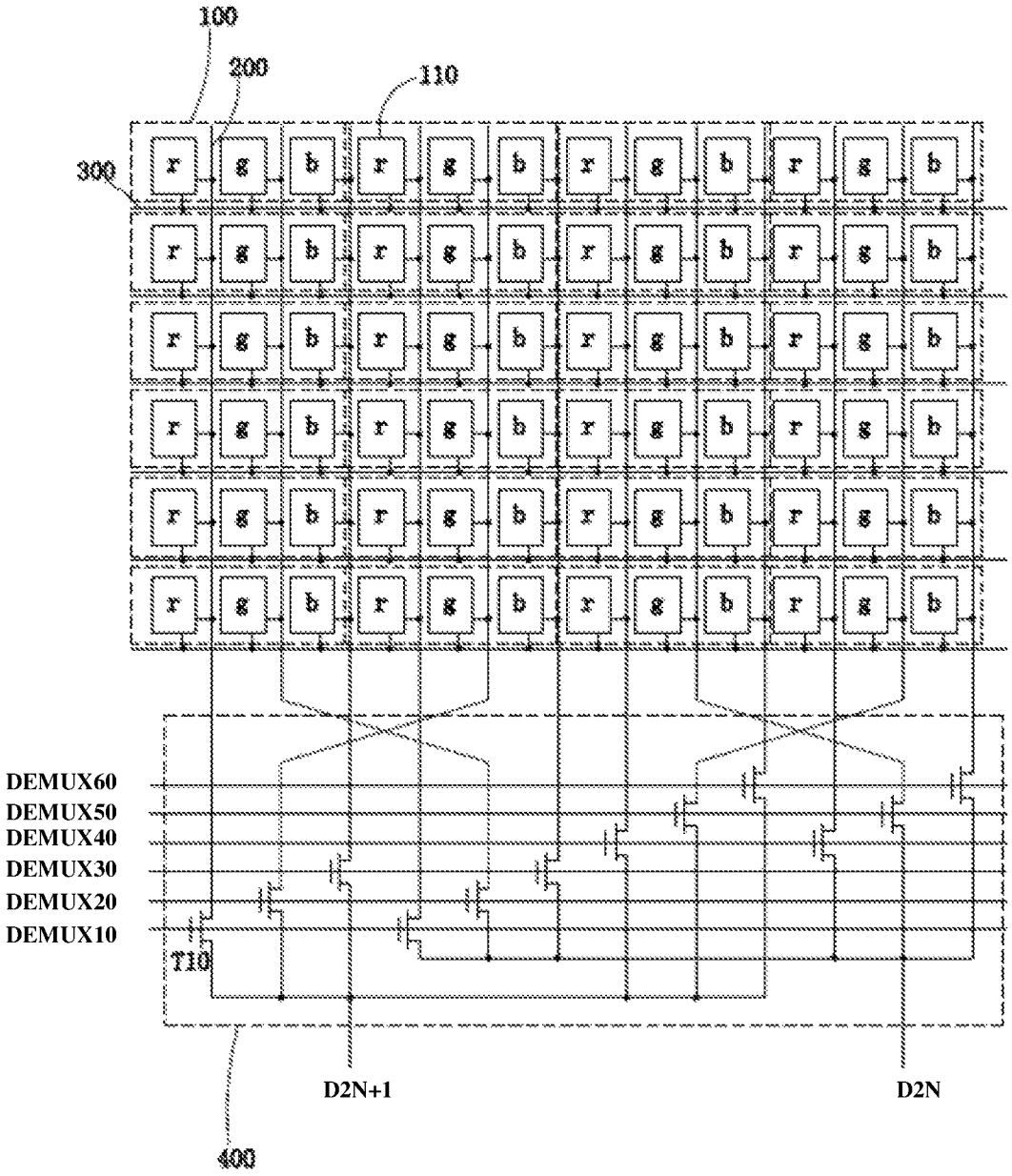
FIG. 1 is a structural schematic diagram of a display panel of the existing one-to-six demultiplexer (De-mux) driving structure.
Figure 2:
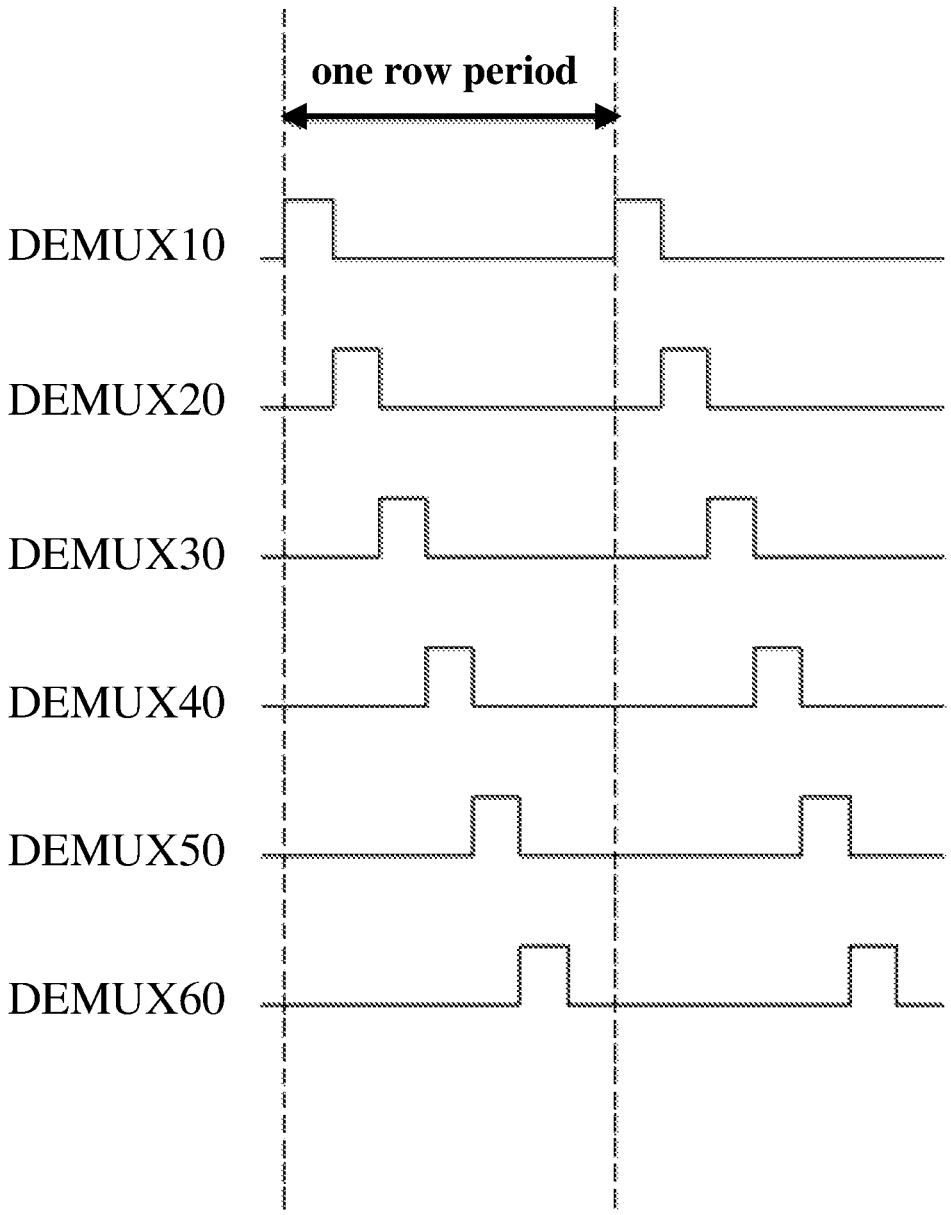
FIG. 2 is a driving time sequence diagram of the display panel illustrated in FIG. 1.
Figure 3:
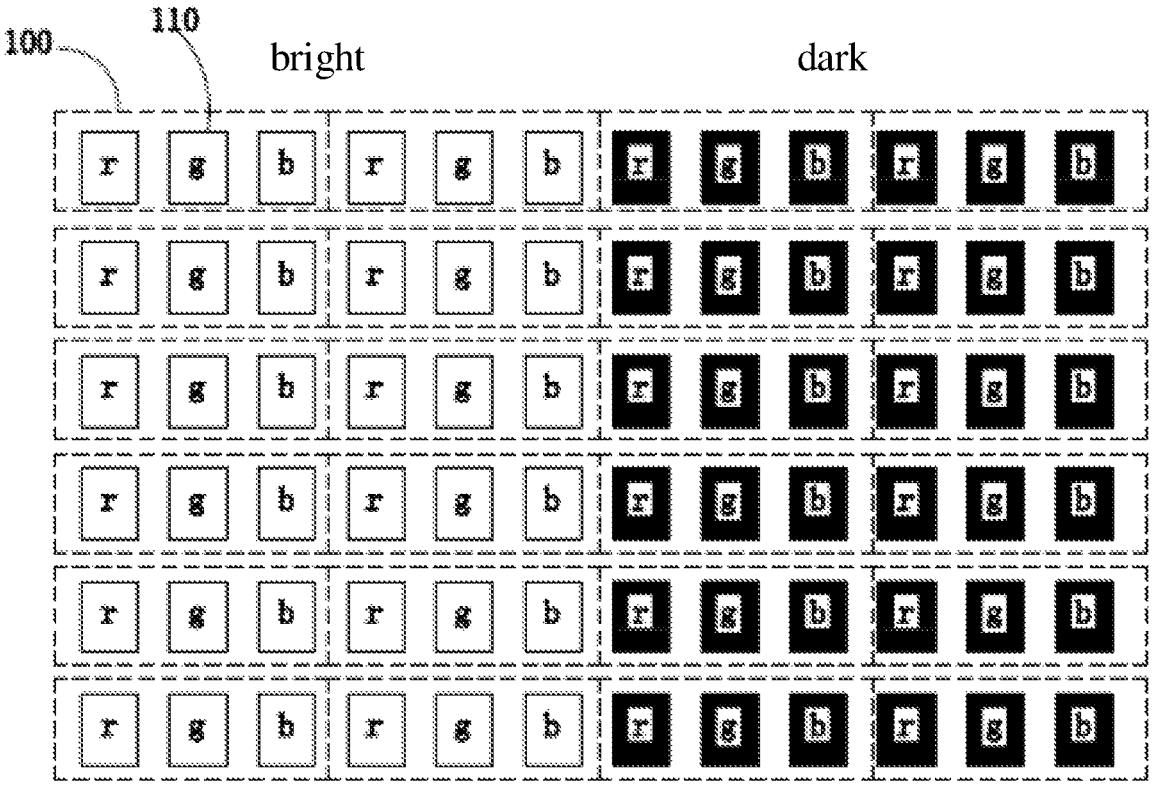
FIG. 3 is a display effect diagram of the display panel illustrated in FIG. 1.
Figure 4:
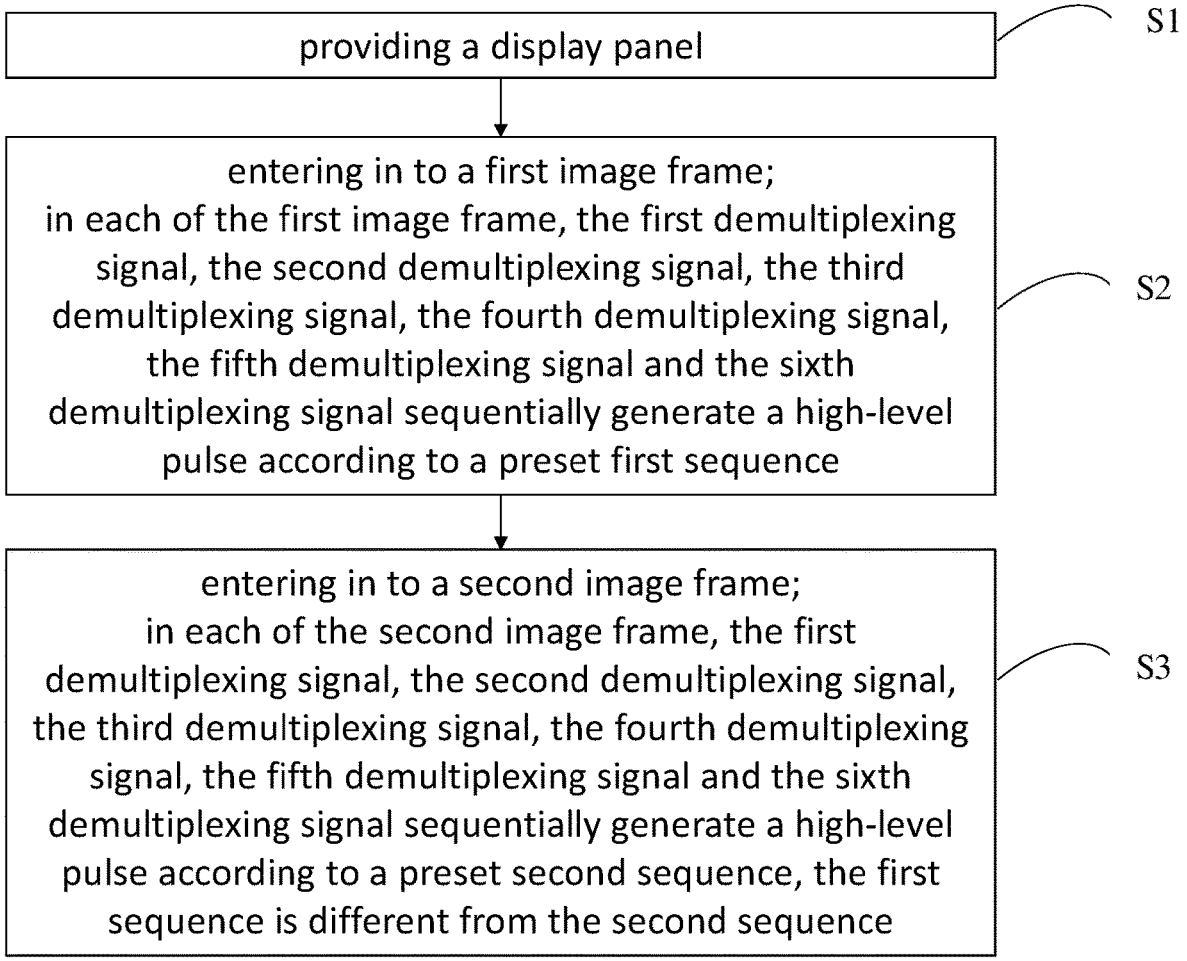
FIG. 4 is a flowchart of the driving method for the display panel of the present disclosure.

Please refer to FIG. 4, the present disclosure provides a driving method for a display panel, including:

Step S1: providing a display panel.

Figure 5:
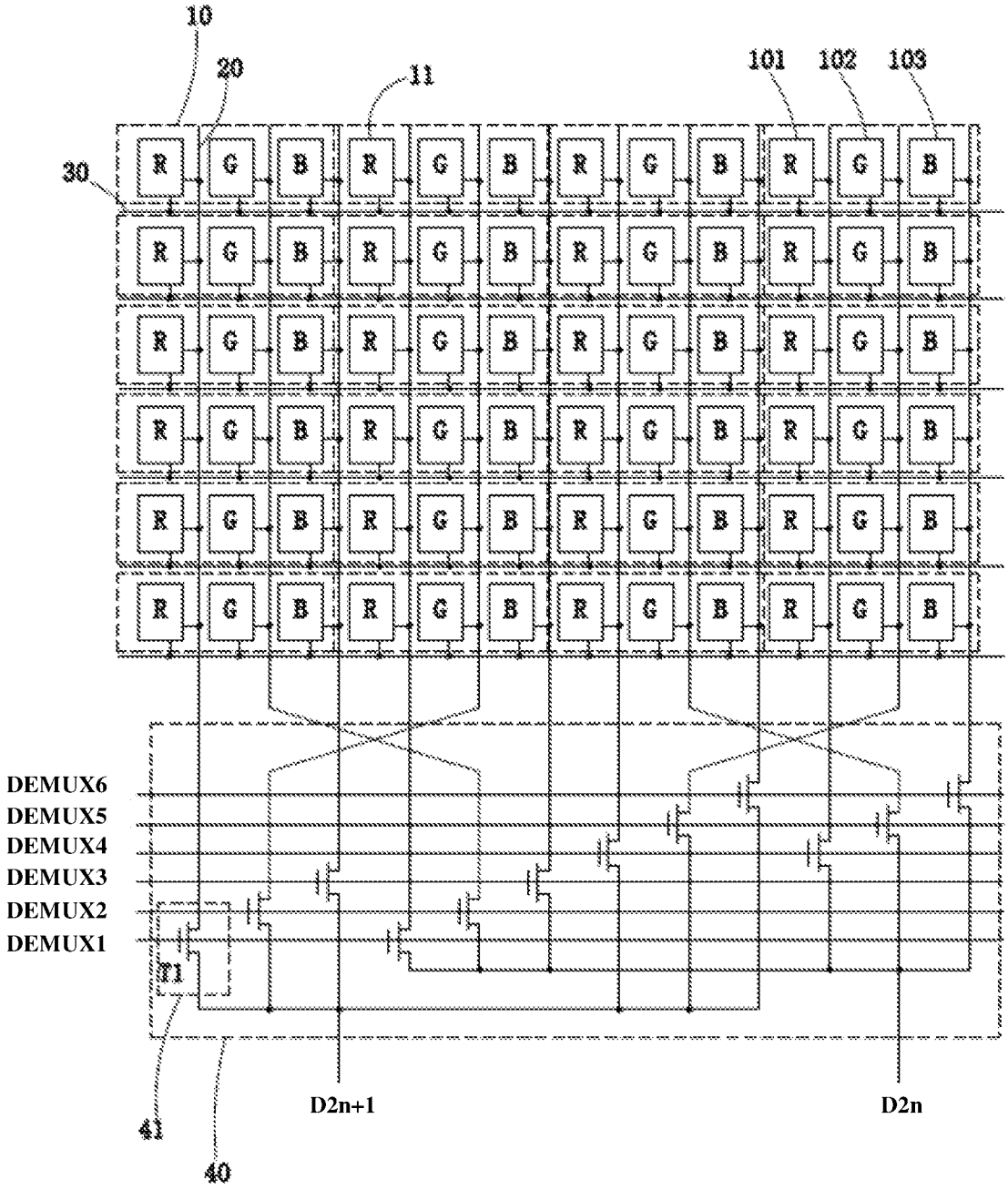
FIG. 5 is a schematic diagram of the step S1 of the driving method for the display panel of the present disclosure.

As illustrated in FIG. 5, the display panel includes a plurality of driving units; each of the driving units includes a plurality of pixels 10 and pixels 12 which are arranged in a plurality of rows and four columns, twelve data lines 20 and a demultiplexing module 40; each of the pixel includes three subpixels 11 which are arranged in one of the rows, and the three subpixels 11 are a first subpixel 101, a second subpixel 102 and a third subpixel 103 sequentially, and one of the data lines 20 is connected to a column of the subpixels 11; the demultiplexing module 40 includes twelve switch elements 41 which respectively correspond to the subpixels 11, output ends of the twelve switch elements 41 are respectively connected to the data lines 20 connected to their corresponding columns of subpixels 11; the output ends of the switch elements 41 corresponding to the odd integer column subpixels 10 are accessed to a nth data signal D2n+1, where n is a natural number, and the output ends of the switch elements 41 corresponding to the even integer column subpixels 10 are accessed to a 2nth data signal D2n; a control terminal of the switch elements 41 which the first subpixels 101 of the first column pixels 10 and the second column pixels 10 correspond to is accessed a first demultiplexing signal DEMUX1; a control terminal of the switch elements which the second subpixels 102 of the first column pixels 10 and the second column pixels 10 correspond to is accessed a second demultiplexing signal DEMUX2; a control terminal of the switch elements 41 which the third subpixels 103 of the first column pixels 10 and the second column pixels 10 correspond to is accessed a third demultiplexing signal DEMUX3; a control terminal of the switch elements 41 which the first subpixels 101 of the third column pixels 10 and the fourth column pixels 10 correspond to is accessed a fourth demultiplexing signal DEMUX4; a control terminal of the switch elements 41 which the second subpixels 102 of the third column pixels 10 and the fourth column pixels 10 correspond to is accessed a fifth demultiplexing signal DEMUX5; a control terminal of the switch elements which the third subpixels 103 of the third column pixels 10 and the fourth column pixels 10 correspond to is accessed a sixth demultiplexing signal DEMUX6.

Specifically, the display panel is a liquid crystal display panel or an organic light emitting diode (OLED) display panel.

Specifically, the first subpixel 101, the second subpixel 102 and the third subpixel 103 respectively display red (R) color, green (G) color and blue (B) color, and the colors of the subpixels 11 in a same column are same.

Specifically, the switch element 41 is a thin film transistor T1, the control terminal of the switch element 41 is a gate electrode of the thin film transistor T1, an input end of the switch element 41 is a source electrode of the thin film transistor T1, the output end of the switch element 41 is a drain electrode of the thin film transistor T1.

Further, each of the driving units further includes a plurality of scan lines 30; one row of the subpixels 11 is correspondingly connected to one scan line 30; the mth scan line 30 outputs the mth scan signal Gm to scan the mth row subpixels 11, where m is a positive integer. Each of the scan lines 30 sequentially outputs the scanning signals in order, that is, when a scan signal of one scanning line 30 is at a high electric potential, the scan signals on the remaining scan lines 30 are all at a low electric potential.

Step S2: entering in to a first image frame.

In each of the first image frame, sequentially generating a high-level pulse according to a preset first sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6.

Step S3: entering in to a second image frame.

In each of the second image frame, the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6 sequentially generate a high-level pulse according to a preset second sequence, the first sequence is different from the second sequence.

Specifically, the durations of the high-level pulses of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6 are same.

Specifically, the first image frame and the second image frame are specifically configured according to requirements. The typical setting is that the first image frame is an odd image frame, and the second image frame is an even image frame, and of course, it is not intended to limit the present disclosure. It is also possible to set the first image frame to be the 4q-3th image frame and the 4q-2th image frame, and to set the second image frame to be a 4q-1th image frame and a 4qth image frame, where q is a positive integers, all of these are selectable as needed.

Figure 6:
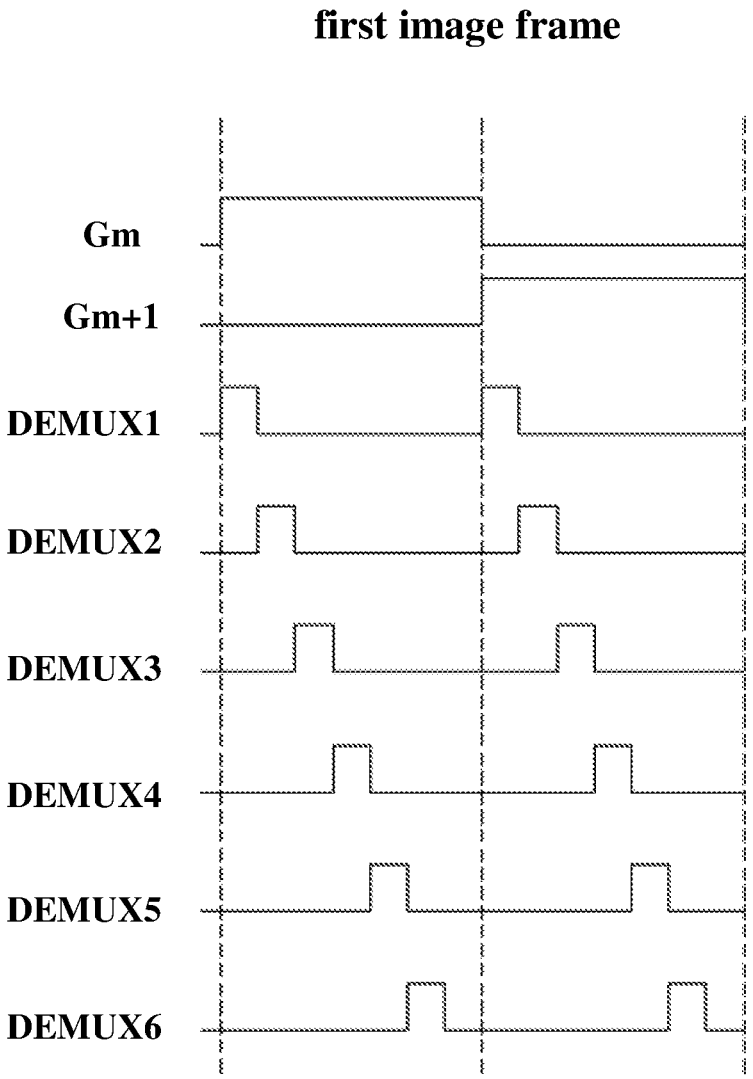
FIG. 6 and FIG. 7 are time sequence diagrams of the first embodiment of the driving method for the display panel of the present disclosure.
Figure 7:
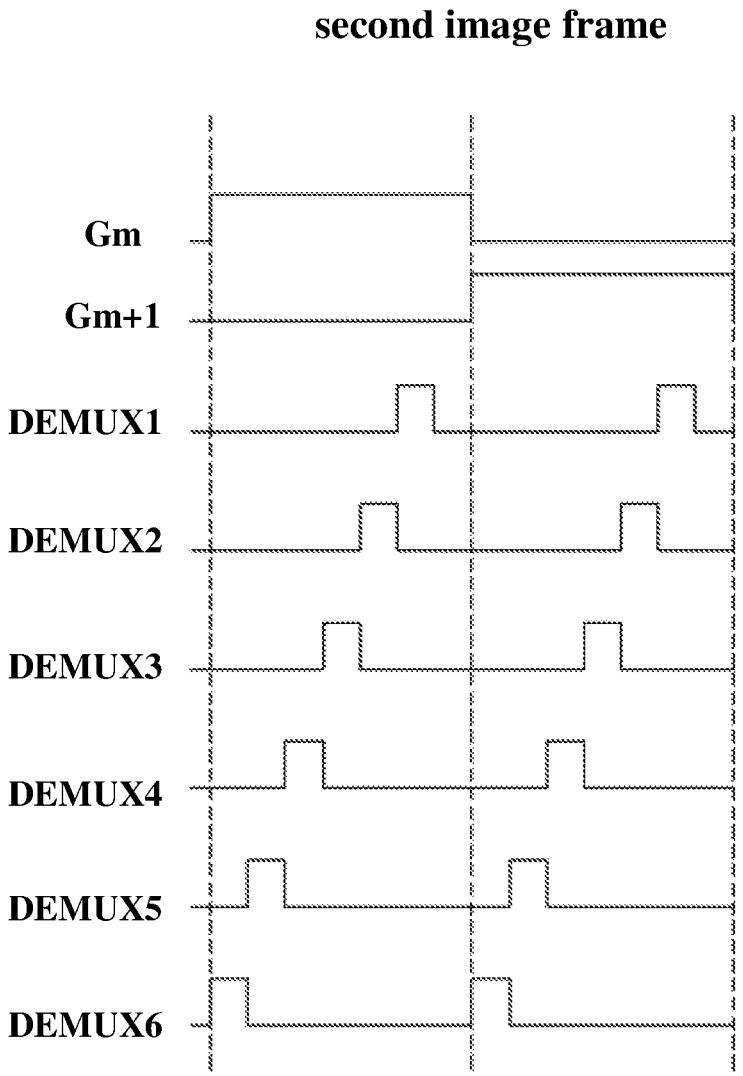

Optionally, as illustrated in FIG. 6 and FIG. 7, in the first embodiment of the present disclosure, the first sequence is: in the first image frame, during scanning each row of the subpixels, sequentially generating the high-level pulse according to a sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6; the second sequence is: in the second image frame, during scanning each row of the subpixels, sequentially generating the high-level pulse according to a sequence of the sixth demultiplexing signal DEMUX6, the fifth demultiplexing signal DEMUX5, the fourth demultiplexing signal DEMUX4, the third demultiplexing signal DEMUX3, the second demultiplexing signal DEMUX2 and the first demultiplexing signal DEMUX1.

It should be noted, that in the first embodiment of the present disclosure, in the first image frame, when scanning each row of the subpixels, sequentially generating the high-level pulse according to a sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6. In the first image frame, this makes the pixels 10 of the first column and the second column of each driving unit are charged first, and the pixels 10 of the third column and the fourth column are charged afterwards; and in the second image frame, when scanning each row of the subpixels, sequentially generating the high-level pulse according to a sequence of the sixth demultiplexing signal DEMUX6, the fifth demultiplexing signal DEMUX5, the fourth demultiplexing signal DEMUX4, the third demultiplexing signal DEMUX3, the second demultiplexing signal DEMUX2 and the first demultiplexing signal DEMUX1, and the pixels 10 of the third column and the fourth column of each driving unit are charged first, and the pixels 10 of the first column and the second column are charged afterwards. Thereby in the first image frame, makes the brightness of the pixels 10 of the first column and the second column of each driving units is larger than the pixels 10 of the third column and the fourth column, and in the second image frame, the brightness of the pixels 10 of the first column and the second column of each driving unit is smaller than the pixels 10 of the third column and the fourth column, thereby through adding the effect of the first image frame and the second image frame, makes the overall brightness of the display panel consistent when displaying, and eliminates stripes on the images displayed by the display panel to improve the display effect.

Figure 8:
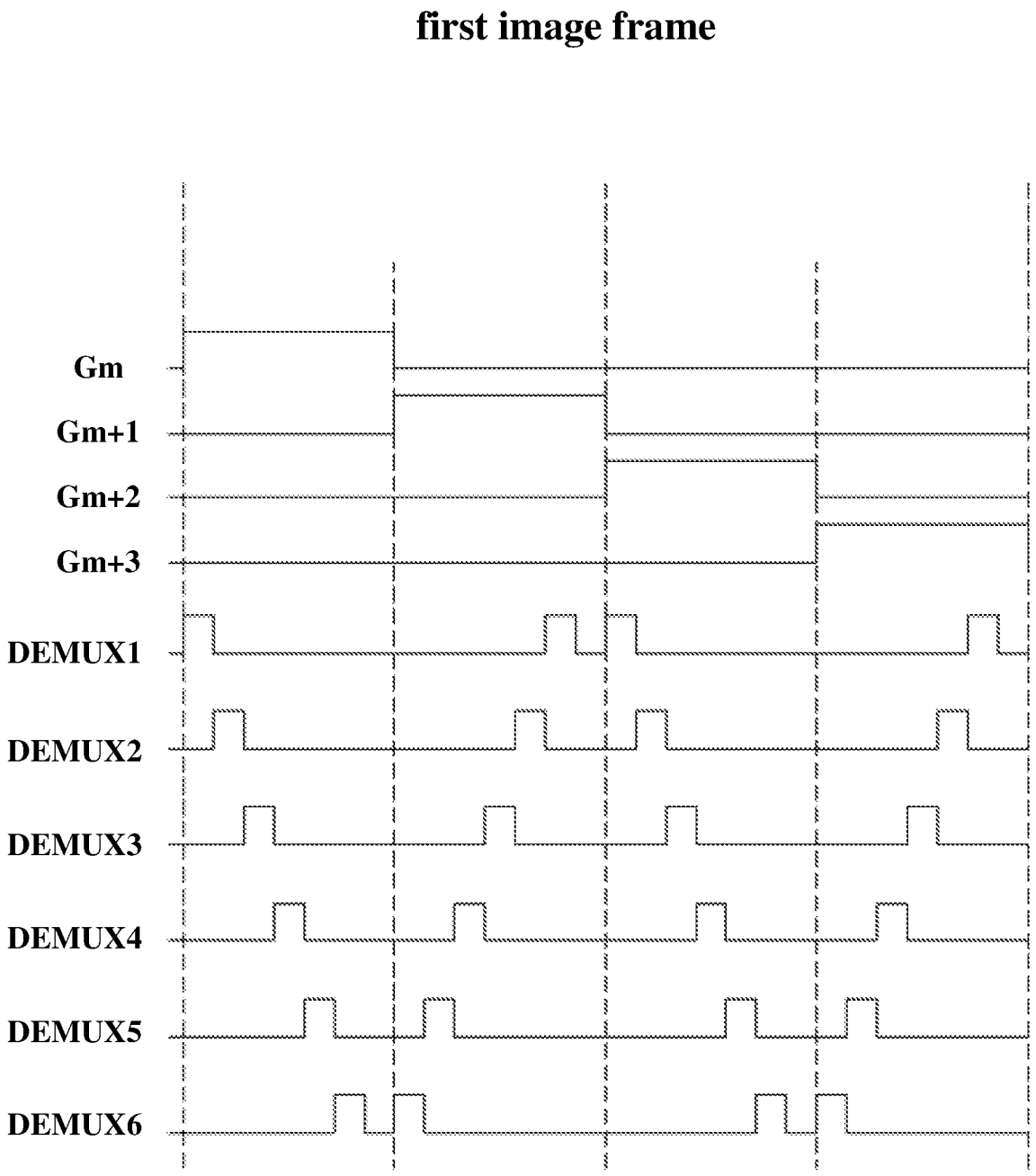
FIG. 8 and FIG. 9 are time sequence diagrams of the second embodiment of the driving method for the display panel of the present disclosure.
Figure 9:
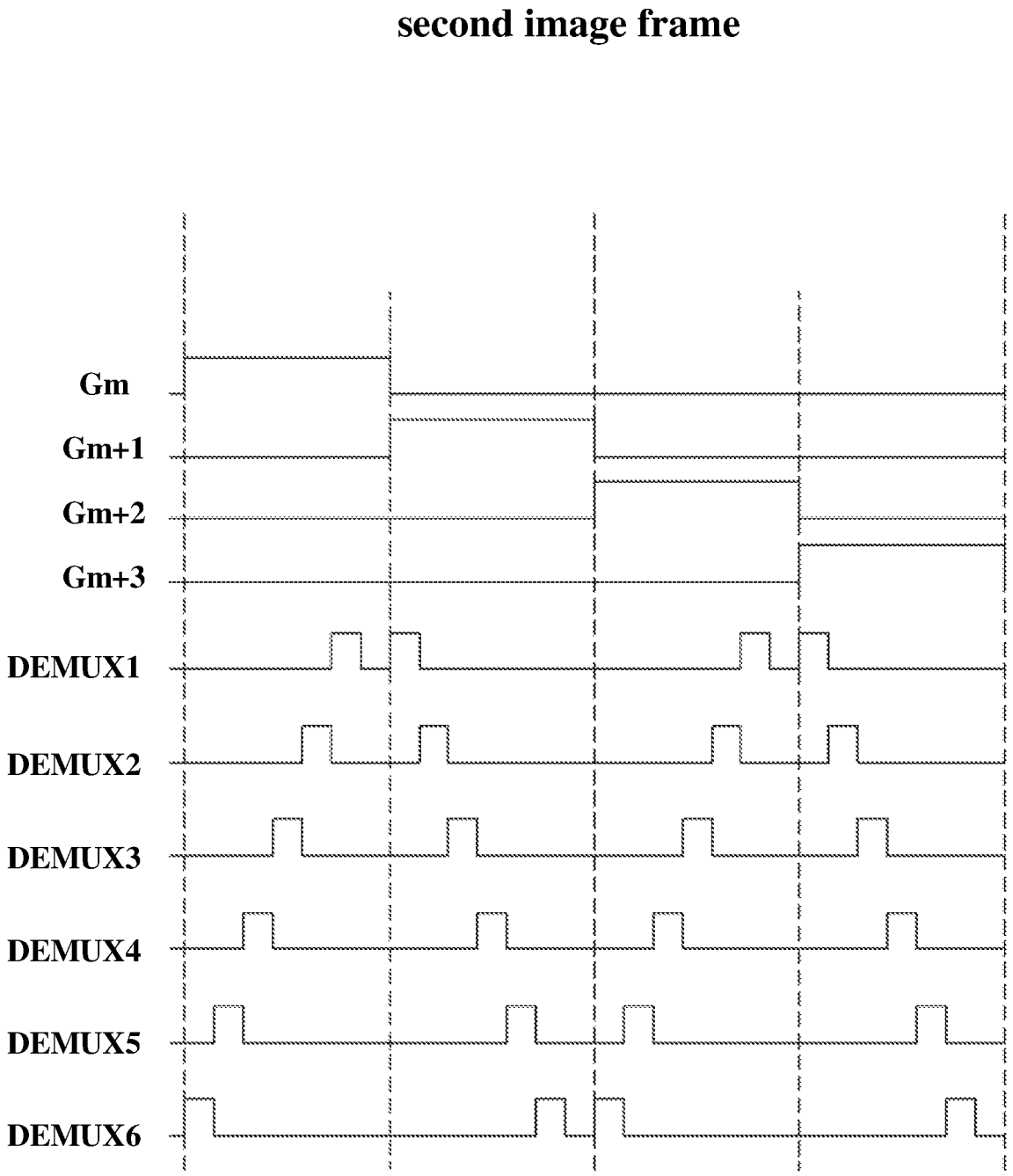

Optionally, as illustrated in FIG. 8 and FIG. 9, the first sequence is: in the first image frame, during scanning the odd row subpixels, sequentially generating the high-level pulse according to a sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6; and during scanning the even row subpixel, sequentially generating the high-level pulse according to a sequence of the sixth demultiplexing signal DEMUX6, the fifth demultiplexing signal DEMUX5, the fourth demultiplexing signal DEMUX4, the third demultiplexing signal DEMUX3, the second demultiplexing signal DEMUX2 and the first demultiplexing signal DEMUX1. The second sequence is: in the second image frame, during scanning the odd row subpixels, sequentially generating the high-level pulse according to a sequence of sixth demultiplexing signal DEMUX6, the fifth demultiplexing signal DEMUX5, the fourth demultiplexing signal DEMUX4, the third demultiplexing signal DEMUX3, the second demultiplexing signal DEMUX2 and the first demultiplexing signal DEMUX1; during scanning the even row subpixels, sequentially generating the high-level pulse according to a sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6.

It should be noted, that in the first image frame, through scanning the odd row subpixels sequentially generating the high-level pulse according to a preset first sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6; and during scanning the even row subpixels, sequentially generating the high-level pulse according to a sequence of the sixth demultiplexing signal DEMUX6, the fifth demultiplexing signal DEMUX5, the fourth demultiplexing signal DEMUX4, the third demultiplexing signal DEMUX3, the second demultiplexing signal DEMUX2 and the first demultiplexing signal DEMUX1; for the odd row subpixels in the first image frame, making the pixels 10 of the first column and the second column of each driving unit are charged first, and the pixels 10 of the third column and the fourth column are charged afterwards; and in the even row subpixels, the pixels 10 of the third column and the fourth column of each driving units are charged first, and the pixels 10 of the first column and the second column are charged afterwards. Thereby for the odd row subpixels in the first image frame, makes the brightness of the pixels 10 of the first column and the second column of each driving unit is larger than the pixels 10 of the third column and the fourth column, and for the even row subpixels in the second image frame, the brightness of the pixels 10 of the first column and the second column of each driving unit is smaller than the pixels 10 of the third column and the fourth column. In the second image frame, when scanning the odd row subpixels, sequentially generating the high-level pulse according to a sequence of the sixth demultiplexing signal DEMUX6, the fifth demultiplexing signal DEMUX5, the fourth demultiplexing signal DEMUX4, the third demultiplexing signal DEMUX3, the second demultiplexing signal DEMUX2 and the first demultiplexing signal DEMUX1; and when scanning the even row subpixels, sequentially generating the high-level pulse according to a sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6; for the odd row subpixels in the second image frame, this makes the pixels 10 of the third column and the fourth column of each driving unit are charged first, and the pixels 10 of the first column and the second column are charged afterwards; and in the even row subpixels, the pixels 10 of the first column and the second column of each driving unit are charged first, and the pixels 10 of the third column and the fourth column are charged afterwards. Thereby for the odd row subpixels in the second image frame, making the brightness of the pixels 10 of the first column and the second column of each driving unit is smaller than the pixels 10 of the third column and the fourth column, and the even row subpixels in the second image frame, the brightness of the pixels 10 of the first column and the second column of each driving unit is larger than the pixels 10 of the third column and the fourth column. Thereby through the difference of brightness between the odd row subpixels and the even row subpixels in the same image frame, and with adding the effect of the first image frame and the second image frame, makes the overall brightness of the display panel consistent when displaying, and eliminates stripes on the images displayed by the display panel to improve the display effect.

Figure 10:
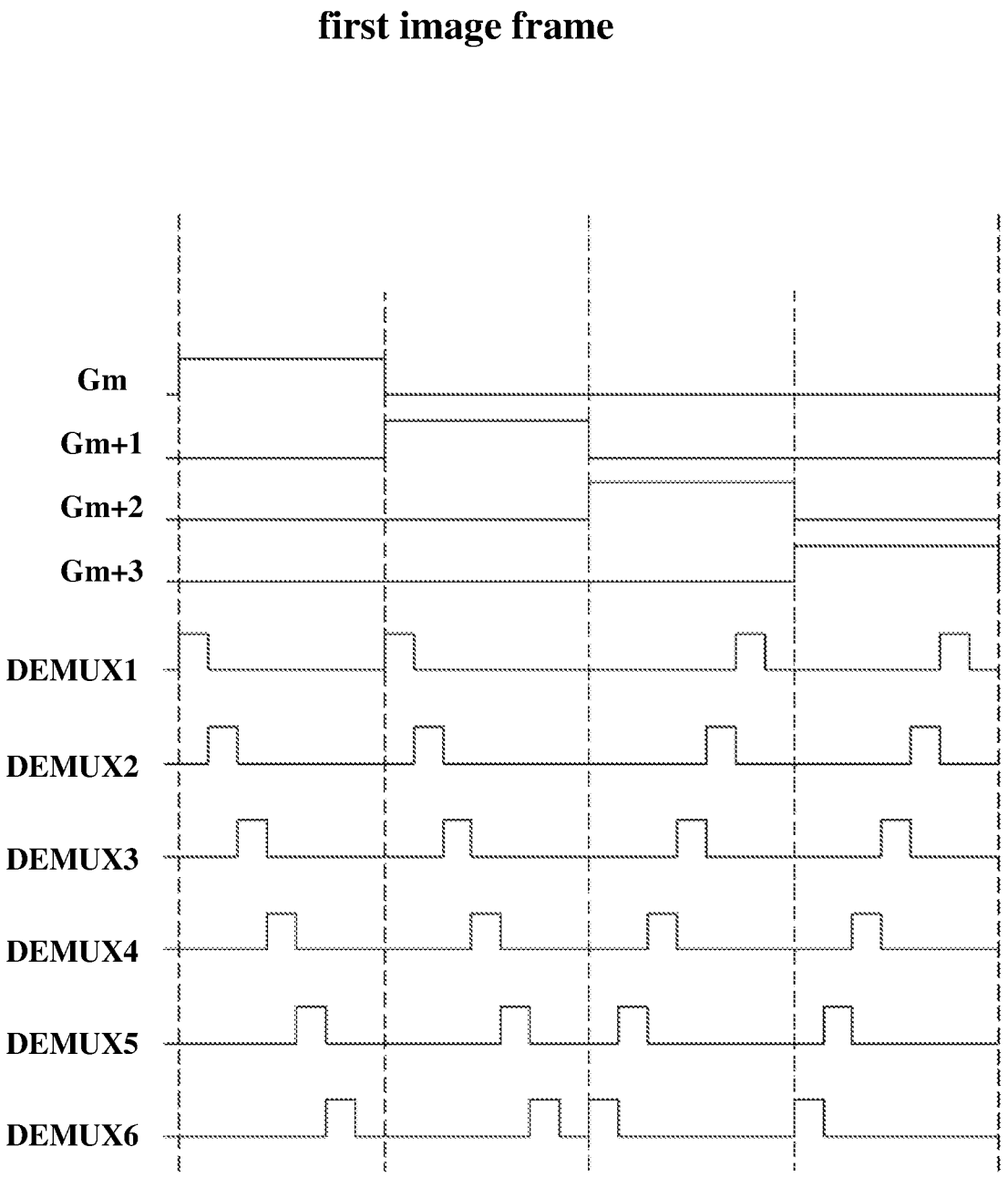
FIG. 10 and FIG. 11 are time sequence diagrams of the third embodiment of the driving method for the display panel of the present disclosure.
Figure 11:
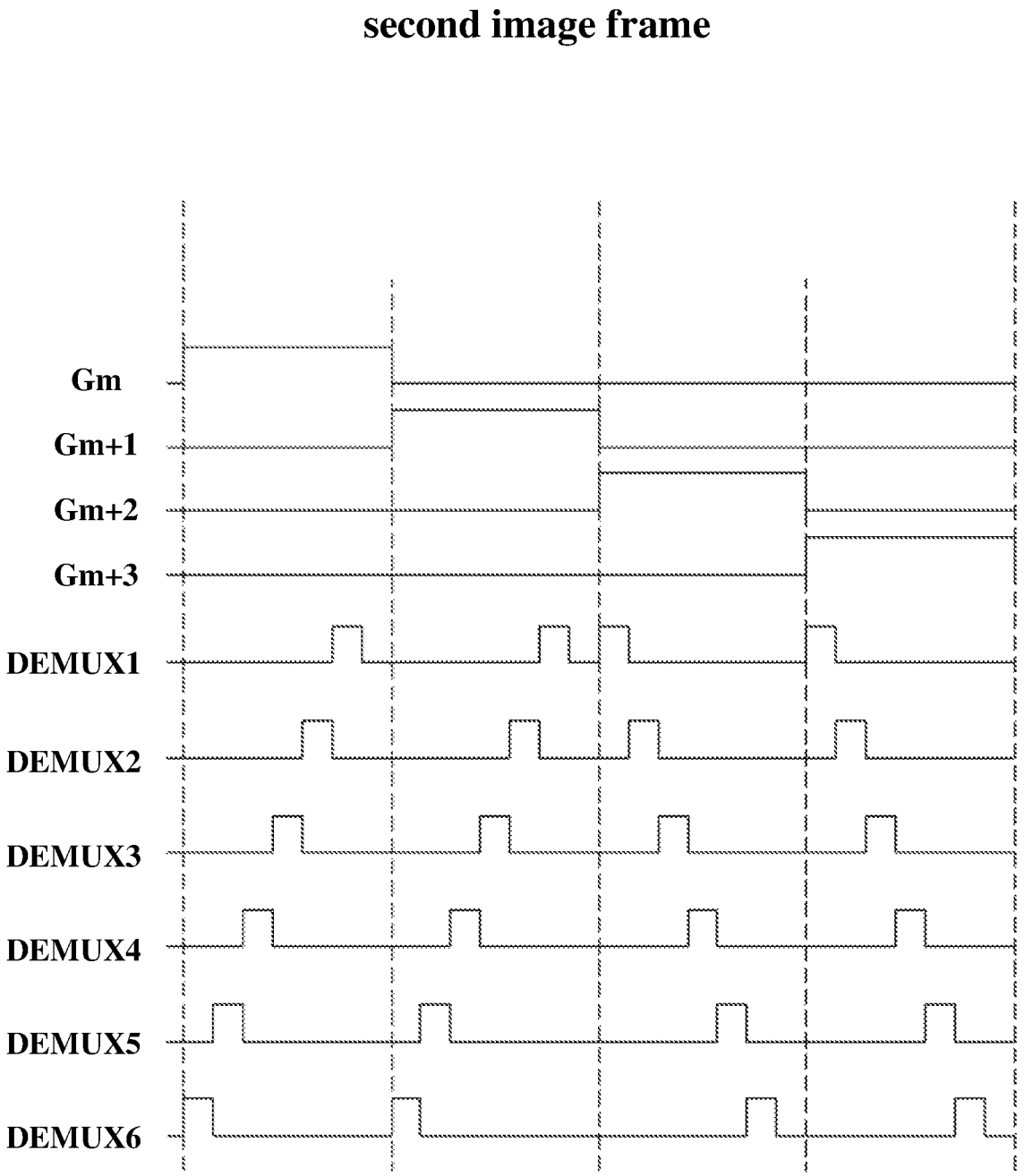

Optionally, as illustrated in FIG. 10 and FIG. 11, in the third embodiment of the present disclosure, the first sequence is: in the first image frame, when scanning the 4i-3th row subpixels and the 4i-2th row subpixels, sequentially generating the high-level pulse according to a sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6; during scanning the 4i-1th row subpixels and the 4ith row subpixels, sequentially generating the high-level pulse according to a sequence of the sixth demultiplexing signal DEMUX6, the fifth demultiplexing signal DEMUX5, the fourth demultiplexing signal DEMUX4, the third demultiplexing signal DEMUX3, the second demultiplexing signal DEMUX2 and the first demultiplexing signal DEMUX1.

The second sequence is: in the second image frame, during scanning the 4i-3th row subpixels and the 4i-2th row subpixels, sequentially generating the high-level pulse according to a sequence of the sixth demultiplexing signal DEMUX6, the fifth demultiplexing signal DEMUX5, the fourth demultiplexing signal DEMUX4, the third demultiplexing signal DEMUX3, the second demultiplexing signal DEMUX2 and the first demultiplexing signal DEMUX1; during scanning the 4i-1th row subpixels and the 4ith row subpixels, sequentially generating the high-level pulse according a sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6, wherein i is a positive integer.

It should be noted, that in the third embodiment, through the difference of brightness between the 4i-3th row subpixels, the 4i-2th row subpixels and the 4i-1th row subpixels, the 4ith row subpixels, and with adding the effect of the first image frame and the second image frame, makes the overall brightness of the display panel consistent when displaying, and eliminates stripes on the images displayed by the display panel to improve the display effect.

Figure 12:
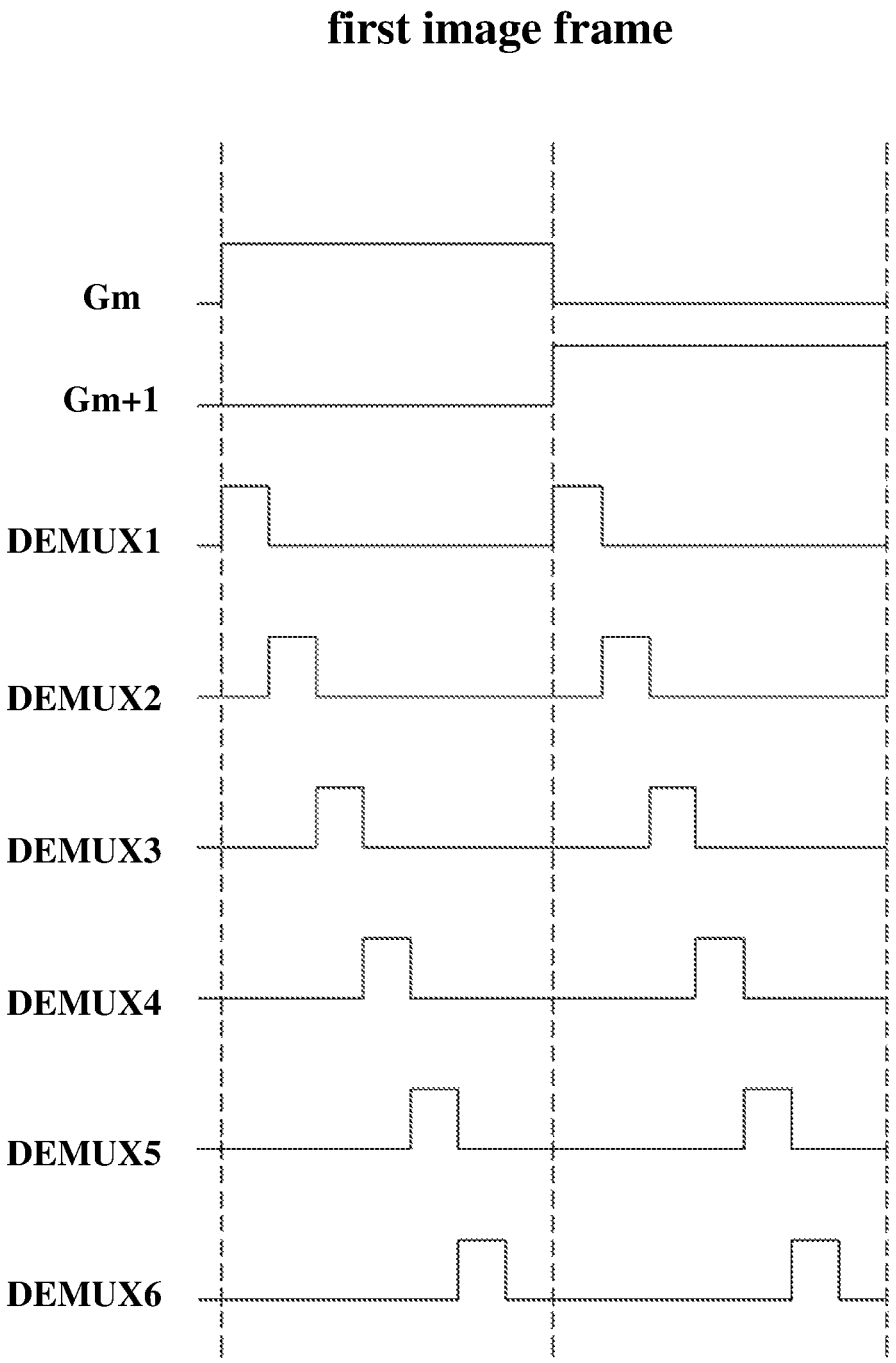
FIG. 12 and FIG. 13 are time sequence diagrams of the fourth embodiment of the driving method for the display panel of the present disclosure.
Figure 13:
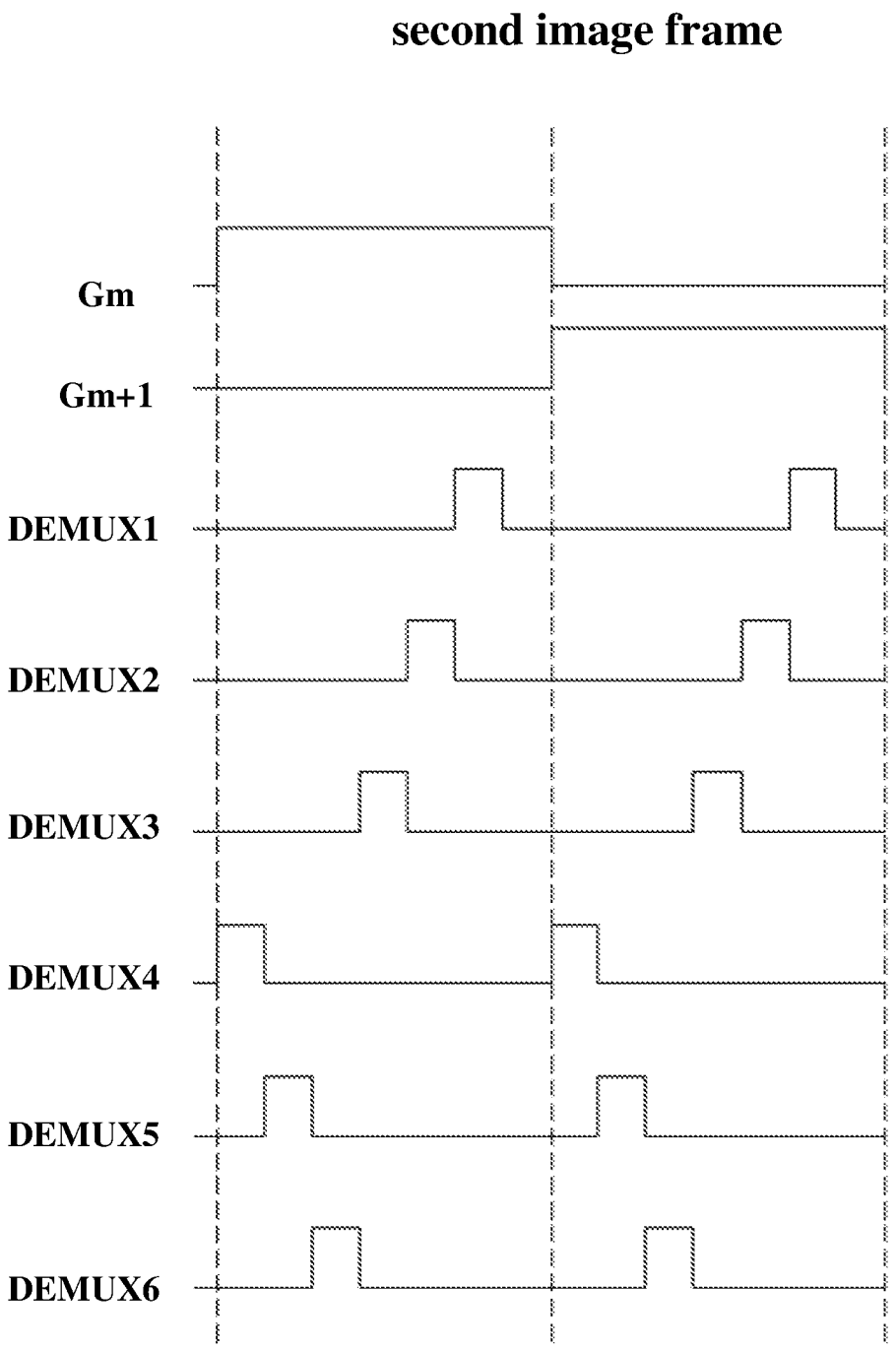

Optionally, as illustrated in FIG. 12 and FIG. 13, as illustrated in the fourth embodiment of the present disclosure, the first sequence is: in the first image frame, during scanning each row of the subpixels, sequentially generating the high-level pulse according to a sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6.

The second sequence is: in the second image frame, during scanning each row of the subpixels, sequentially generating the high-level pulse according to a sequence of the fourth demultiplexing signal DEMUX4, the fifth demultiplexing signal DEMUX5, the sixth demultiplexing signal DEMUX6, the first demultiplexing signal DEMUX1, the second demultiplexing signal DEMUX2 and the third demultiplexing signal DEMUX3.

It should be noted, that in the fourth embodiment, through adding the effect of the first image frame and the second image frame, makes the overall brightness of the display panel consistent when displaying, and eliminates stripes on the images displayed by the display panel to improve the display effect.

Figure 14:
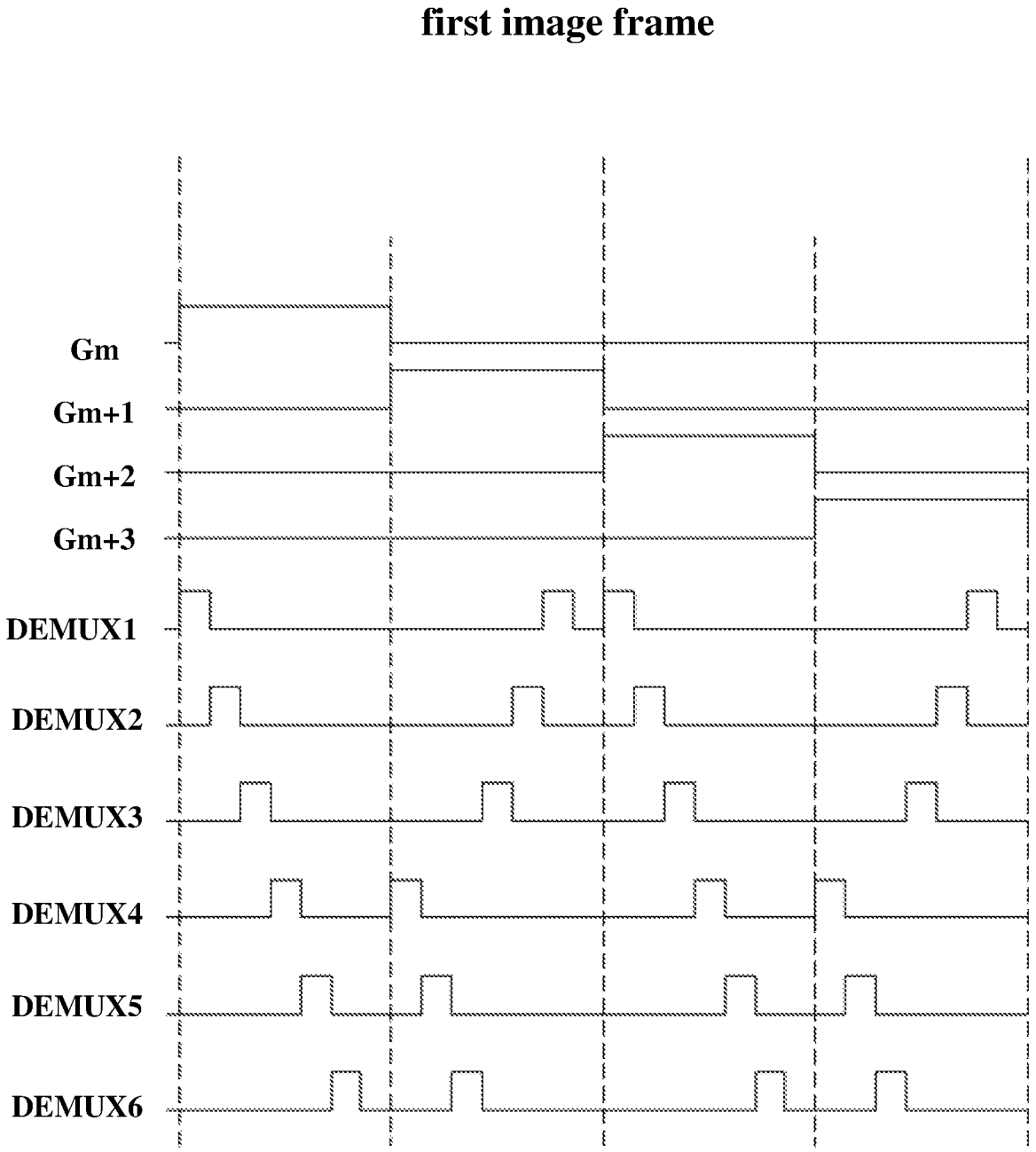
FIG. 14 and FIG. 15 are time sequence diagrams of the fifth embodiment of the driving method for the display panel of the present disclosure.
Figure 15:
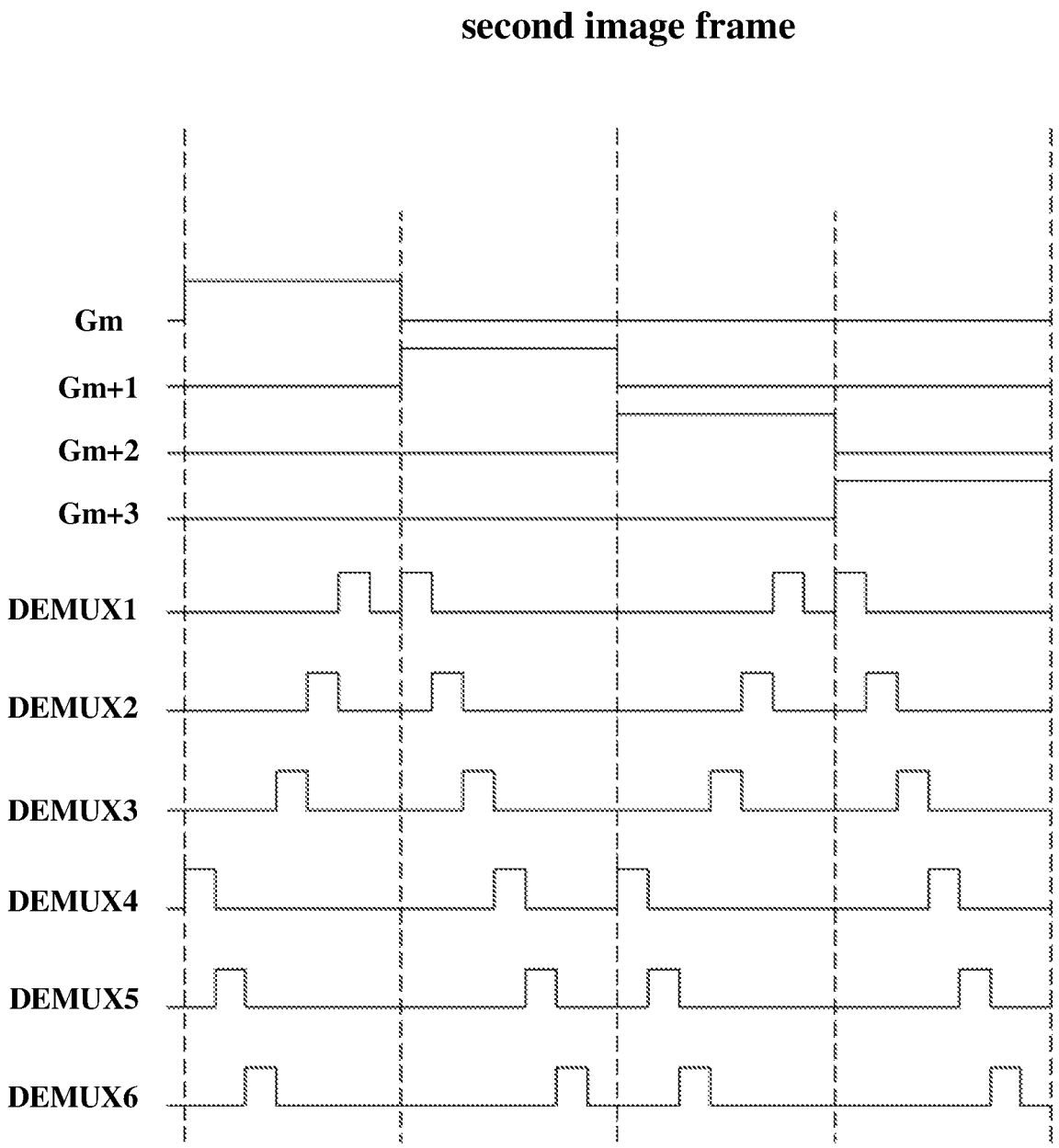

Optionally, as illustrated in FIG. 14 and FIG. 15, in the fifth embodiment of the present disclosure, the first sequence is: in the first image frame, during scanning the odd row subpixels, sequentially generating the high-level pulse according to a sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6; during scanning the even row subpixels, sequentially generating the high-level pulse according to a sequence of the fourth demultiplexing signal DEMUX4, the fifth demultiplexing signal DEMUX5, the sixth demultiplexing signal DEMUX6, the first demultiplexing signal DEMUX1, the second demultiplexing signal DEMUX2 and the third demultiplexing signal DEMUX3.

The second sequence is: in the second image frame, during scanning the odd row subpixels, sequentially generating the high-level pulse according to a sequence of the fourth demultiplexing signal DEMUX4, the fifth demultiplexing signal DEMUX5, the sixth demultiplexing signal DEMUX6, the first demultiplexing signal DEMUX1, the second demultiplexing signal DEMUX2 and the third demultiplexing signal DEMUX3, during scanning the even row subpixels, sequentially generating the high-level pulse according a sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6.

It should be noted, that in the fifth embodiment, through the difference of brightness between the odd row subpixels and the even row subpixels, and with adding the effect of the first image frame and the second image frame, makes the overall brightness of the display panel consistent when displaying, and eliminates stripes on the images displayed by the display panel to improve the display effect.

Figure 16:
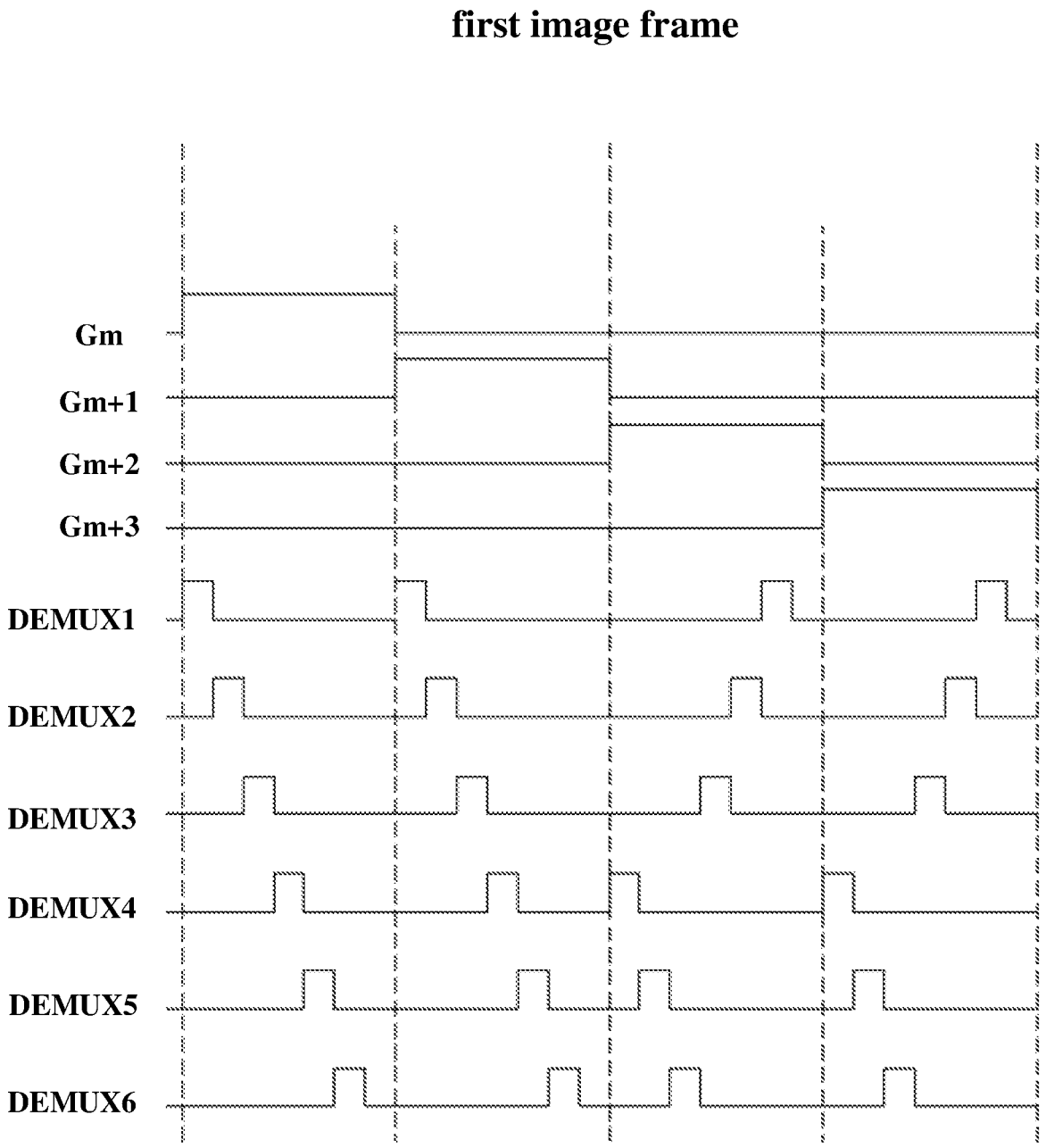
FIG. 16 and FIG. 17 are time sequence diagrams of the sixth embodiment of the driving method for the display panel of the present disclosure.
Figure 17:
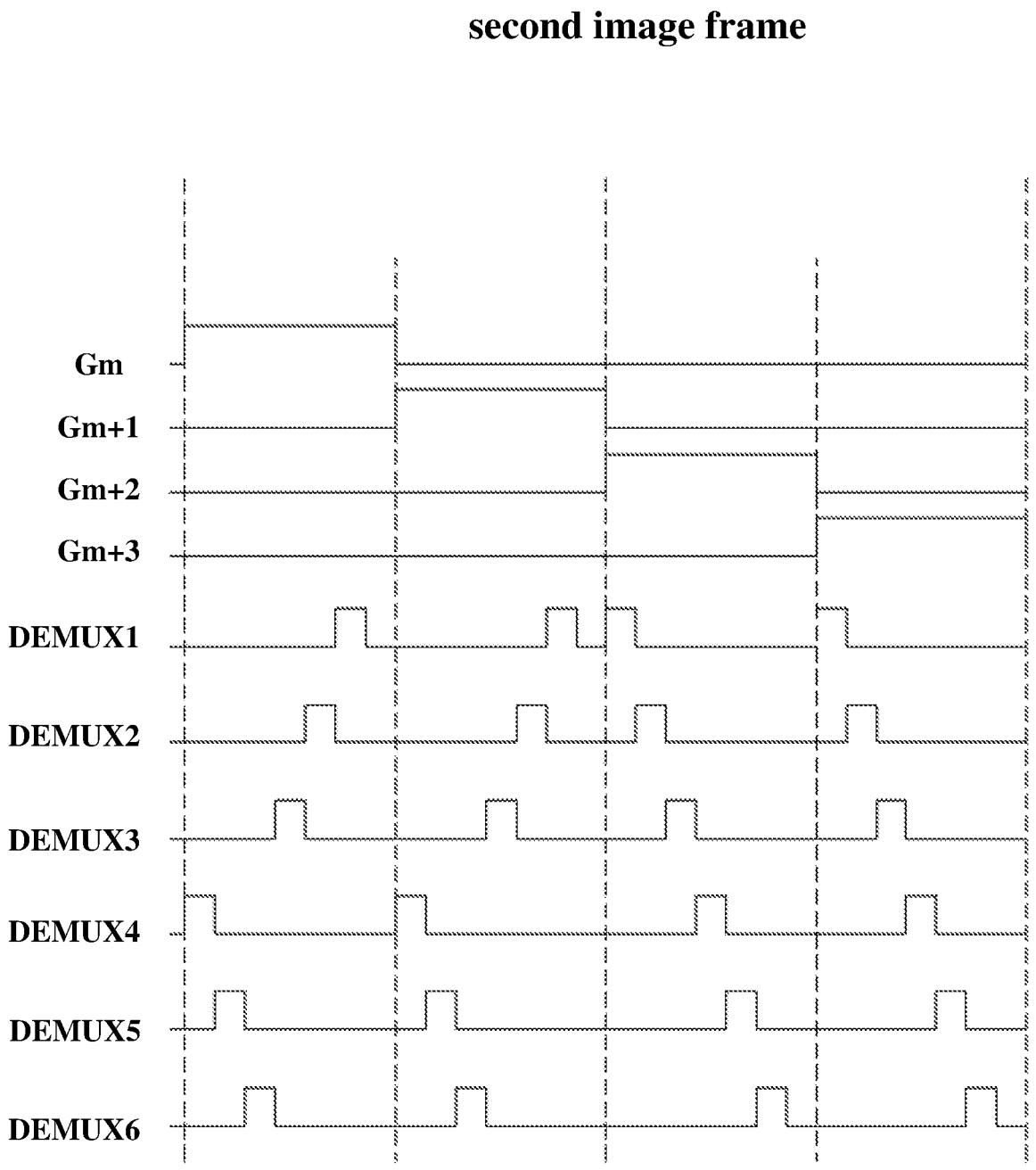

Optionally, as illustrated in FIG. 16 and FIG. 17, in the sixth embodiment of the present disclosure, the first sequence is: during scanning the 4i-3th row subpixels and the 4i-2th row subpixels, sequentially generating the high-level pulse according to a sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6; during scanning the 4i-1th row subpixels and the 4ith row subpixels, sequentially generating the high-level pulse according a sequence of the fourth demultiplexing signal DEMUX4, the fifth demultiplexing signal DEMUX5, the sixth demultiplexing signal DEMUX6, the first demultiplexing signal DEMUX1, the second demultiplexing signal DEMUX2 and the third demultiplexing signal DEMUX3.

The second sequence is: in the second image frame, during scanning the 4i-3th row subpixels and the 4i-2th row subpixels, sequentially generating the high-level pulse according to a sequence of the fourth demultiplexing signal DEMUX4, the fifth demultiplexing signal DEMUX5, the sixth demultiplexing signal DEMUX6, the first demultiplexing signal DEMUX1, the second demultiplexing signal DEMUX2 and the third demultiplexing signal DEMUX3, during scanning the 4i-1th row subpixels and the 4ith row subpixels, sequentially generating the high-level pulse according a sequence of the first demultiplexing signal DEMUX1, the second demultiplexing signal DEMUX2, the third demultiplexing signal DEMUX3, the fourth demultiplexing signal DEMUX4, the fifth demultiplexing signal DEMUX5 and the sixth demultiplexing signal DEMUX6, wherein i is a positive integer.

It should be noted, that in the sixth embodiment, through the difference of brightness between the 4i-3th row subpixels, the 4i-2th row subpixels and the 4i-1th row subpixels, the 4ith row subpixels, and with adding the effect of the first image frame and the second image frame, makes the overall brightness of the display panel consistent when displaying, and eliminates stripes on the images displayed by the display panel to improve the display effect.

In summary, the present disclosure provides an driving method for a display panel, through making the first demultiplexing signal, the second demultiplexing signal, the third demultiplexing signal, the fourth demultiplexing signal, the fifth demultiplexing signal and the sixth demultiplexing signal according to the first sequence generate the high-level pulse in the first image frame, and through making the first demultiplexing signal, the second demultiplexing signal, the third demultiplexing signal, the fourth demultiplexing signal, the fifth demultiplexing signal and the sixth demultiplexing signal according to the second sequence different from the first sequence generate the high-level pulse in the second image frame, thereby by adding the effect of the two image frames to eliminate stripes on the images displayed by the display panel to improve the display effect.

In the above, for those of ordinary skill in the art, various other corresponding changes and modifications can be made according to the technical solutions and technical ideas of the present disclosure, and all such changes and modifications are intended to fall within the scope of protection of the claims of the present disclosure.

What is claimed is:

1. A driving method for a display panel, comprising:

step S1: providing a display panel;

the display panel comprises a plurality of driving units; each of the driving units comprises a plurality of pixels which are arranged in a plurality of rows and four columns, twelve data lines and a demultiplexing module; each of the pixels comprises three subpixels which are arranged in one of the rows, and the three subpixels are a first subpixel, a second subpixel and a third subpixel sequentially, one of the data lines is correspondingly connected to one column of the subpixels; the demultiplexing module comprises twelve switch elements which respectively correspond to the subpixels, output ends of the twelve switch elements are respectively connected to the data lines connected to their corresponding columns of the subpixels;

setting n as a natural number, the output ends corresponding to odd integer column subpixels are accessed to a 2n+1th data signal, and the output ends corresponding to even integer column subpixels are accessed to a 2nth data signal;

a control terminal of the switch elements which the first subpixels of the first column pixels and the second column pixels correspond to is accessed a first demultiplexing signal; a control terminal of the switch elements which the second subpixels of the first column pixels and the second column pixels correspond to is accessed a second demultiplexing signal; a control terminal of the switch elements which the third subpixels of the first column pixels and the second column pixels correspond to is accessed a third demultiplexing signal; a control terminal of the switch elements which the first subpixels of the third column pixels and the fourth column pixels correspond to is accessed a fourth demultiplexing signal; a control terminal of the switch elements which the second subpixels of the third column pixels and the fourth column pixels correspond to is accessed a fifth demultiplexing signal; a control terminal of the switch elements which the third subpixels of the third column pixels and the fourth column pixels correspond to is accessed a sixth demultiplexing signal;

step S2: entering in to a first image frame;

in each of the first image frame, the first demultiplexing signal, the second demultiplexing signal, the third demultiplexing signal, the fourth demultiplexing signal, the fifth demultiplexing signal and the sixth demultiplexing signal sequentially generate a high-level pulse according to a preset first sequence;

step S3: entering in to a second image frame;

in each of the second image frame, the first demultiplexing signal, the second demultiplexing signal, the third demultiplexing signal, the fourth demultiplexing signal, the fifth demultiplexing signal and the sixth demultiplexing signal sequentially generate a high-level pulse according to a preset second sequence, the first sequence is different from the second sequence, wherein i is a positive integer, wherein the first sequence is: in the first image frame, during scanning the odd row subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal; during scanning the even row subpixels, sequentially generating the high-level pulse according to a sequence of the sixth demultiplexing signal, the fifth demultiplexing signal, the fourth demultiplexing signal, the third demultiplexing signal, the second demultiplexing signal and the first demultiplexing signal; and the second sequence is: in the second image frame, during scanning the odd row subpixels, sequentially generating the high-level pulse according to a sequence of the sixth demultiplexing signal, the fifth demultiplexing signal, the fourth demultiplexing signal, the third demultiplexing signal, the second demultiplexing signal and the first demultiplexing signal; during scanning the even row subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal; or the first sequence is: in the first image frame, during scanning the 4i-3th row subpixels and the 4i-2th row subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal; during scanning the 4i-1th row subpixels and the 4ith row subpixels, sequentially generating the high-level pulse according to a sequence of the sixth demultiplexing signal, the fifth demultiplexing signal, the fourth demultiplexing signal, the third demultiplexing signal, the second demultiplexing signal and the first demultiplexing signal; and the second sequence is: in the second image frame, during scanning the 4i-3th row subpixels and the 4i-2th row subpixels, sequentially generating the high-level pulse according to a sequence of the sixth demultiplexing signal, the fifth demultiplexing signal, the fourth demultiplexing signal, the third demultiplexing signal, the second demultiplexing signal and the first demultiplexing signal; during scanning the 4i-1th row subpixels and the 4ith row subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal; or the first sequence is: in the first image frame, during scanning the odd row subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal; during scanning the even row subpixels, sequentially generating the high-level pulse according to a sequence of the fourth demultiplexing signal, the fifth demultiplexing signal, the sixth demultiplexing signal, the first demultiplexing signal, the second demultiplexing signal and the third demultiplexing signal; and the second sequence is: in the second image frame, during scanning the odd row subpixels, sequentially generating the high-level pulse according to a sequence of the fourth demultiplexing signal, the fifth demultiplexing signal, the sixth demultiplexing signal, the first demultiplexing signal, the second demultiplexing signal and the third demultiplexing signal, during scanning the even row subpixels, sequentially generating the high-level pulse according a sequence of the first demultiplexing signal, the second demultiplexing signal, the third demultiplexing signal, the fourth demultiplexing signal, the fifth demultiplexing signal and the sixth demultiplexing signal; or the first sequence is: in the first image frame, during scanning the 4i-3th row subpixels and the 4i-2th row subpixels, sequentially generating the high-level pulse according to a sequence of the first demultiplexing signal, the second demultiplexing signal, the third demultiplexing signal, the fourth demultiplexing signal, the fifth demultiplexing signal and the sixth demultiplexing signal, during scanning the 4i-1th row subpixels and the 4ith row subpixels, sequentially generating the high-level pulse according to a sequence of the fourth demultiplexing signal, the fifth demultiplexing signal, the sixth demultiplexing signal, the first demultiplexing signal, the second demultiplexing signal and the third demultiplexing signal; and the second sequence is: in the second image frame, during scanning the 4i-3th row subpixels and the 4i-2th row subpixels, sequentially generating the high-level pulse according to a sequence of the fourth demultiplexing signal, the fifth demultiplexing signal, the sixth demultiplexing signal, the first demultiplexing signal, the second demultiplexing signal and the third demultiplexing signal, during scanning the 4i-1th row subpixels and the 4ith row subpixels, sequentially generating the high-level pulse according a sequence of the first demultiplexing signal, the second demultiplexing signal, the third demultiplexing signal, the fourth demultiplexing signal, the fifth demultiplexing signal and the sixth demultiplexing signal.

2. The driving method for the display panel as claimed in claim 1, wherein the switch element is a thin film transistor, and the control terminal of the switch element is a gate electrode of the thin film transistor, an input end of the switch element is a source electrode of the thin film transistor, the output end of the switch element is a drain electrode of the thin film transistor.

3. The driving method for the display panel as claimed in claim 1, wherein each of the driving units further comprises a plurality of scan lines; one row of the subpixels is correspondingly connected to one scan line.

4. The driving method for the display panel as claimed in claim 1, wherein the first image frame is an odd image frame and the second image frame is an even image frame.

* * * * *